US009885988B2

(12) United States Patent
Maeda et al.

(10) Patent No.: US 9,885,988 B2
(45) Date of Patent: Feb. 6, 2018

(54) SHEET CONVEYING APPARATUS AND IMAGE FORMING APPARATUS INCLUDING SAME

(71) Applicant: CANON KABUSHIKI KAISHA, Tokyo (JP)

(72) Inventors: Masanori Maeda, Yokohama (JP); Daisuke Aoki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/156,536

(22) Filed: May 17, 2016

(65) Prior Publication Data

US 2016/0349678 A1 Dec. 1, 2016

(30) Foreign Application Priority Data

May 28, 2015 (JP) ..... 2015-108835

(51) Int. Cl.
*B65H 5/06* (2006.01)
*G03G 15/23* (2006.01)

(52) U.S. Cl.
CPC ..... *G03G 15/234* (2013.01); *B65H 2403/00* (2013.01); *B65H 2403/481* (2013.01); *G03G 2215/00438* (2013.01); *G03G 2215/0132* (2013.01); *Y10T 74/19358* (2015.01)

(58) Field of Classification Search
CPC ..... G03G 15/224; G03G 15/234; G03G 2215/004; G03G 2215/0132; B65H 85/00; B65H 2403/481; B65H 2403/00; Y10T 74/19358
See application file for complete search history.

(56) References Cited

U.S. PATENT DOCUMENTS 6,722,648 B2 * 4/2004 Tsusaka ..... B65H 5/06 271/186
6,994,341 B2 2/2006 Aoki et al.
9,024,984 B2 5/2015 Akatsuka et al.
9,296,585 B2 * 3/2016 Yamada ..... B65H 85/00
2008/0284090 A1 * 11/2008 Honda ..... B65H 29/12 271/225
2013/0106050 A1 * 5/2013 Nishii ..... B65H 85/00 271/225
2014/0016979 A1 * 1/2014 Suzuki ..... G03G 15/1615 399/388

(Continued)

FOREIGN PATENT DOCUMENTS

JP 2003-215874 A 7/2003
JP 2009-96620 A 5/2009

(Continued)

*Primary Examiner* — Jill Culler
*Assistant Examiner* — Marissa Ferguson Samreth
(74) *Attorney, Agent, or Firm* — Fitzpatrick, Cella, Harper & Scinto

(57) ABSTRACT

An image forming apparatus includes a drive unit including a first drive train through which a driving force from the drive source is transmitted to the discharge roller and a second drive train through which a driving force from the drive source is transmitted to the reverse roller, and a switching mechanism, provided on the second drive train, configured to switch a rotating direction of the reverse roller between the forward rotating direction and the reverse rotating direction with the discharge roller rotating in one direction.

7 Claims, 13 Drawing Sheets

(56) References Cited

U.S. PATENT DOCUMENTS

| | | | |
|---|---|---|---|
| 2015/0061219 | A1 | 3/2015 | Murakami et al. |
| 2015/0115526 | A1 | 4/2015 | Harada et al. |

FOREIGN PATENT DOCUMENTS

| | | | | | |
|---|---|---|---|---|---|
| JP | 2009-292614 | A | | 12/2009 | |
| JP | 2011148636 | A1 | * | 12/2009 | ..... B65H 29/58 |
| JP | 2011-13279 | A | | 1/2011 | |
| JP | 2012237899 | A1 | * | 5/2011 | ..... G03G 21/00 |
| JP | 2012140201 | A1 | * | 7/2012 | ..... B65H 29/58 |
| JP | 2014-205111 | A | | 10/2014 | |

* cited by examiner

SHEET CONVEYING APPARATUS AND IMAGE FORMING APPARATUS INCLUDING SAME

BACKGROUND OF THE INVENTION

Field of the Invention

This disclosure relates to an image forming apparatus configured to form an image on a sheet.

Description of the Related Art

Hitherto, an image forming apparatus such as a printer including a first discharge roller that discharges a sheet, to which toner is fixed, to a sheet discharge tray and a second discharge roller that is able to switchback the sheet, for example, for duplex printing on the sheet is known.

As an example of such an image forming apparatus, an image forming apparatus configured to allow a second discharge roller to be normally and reversely rotatable by a stepping motor has been proposed in JP-A-2003-215874. The image forming apparatus conveys the sheet by normally rotating the second discharge roller until a trailing edge of the sheet passes through a reverse sensor and then conveys the sheet to a duplex sheet re-feed path by reversely rotating the second discharge roller.

However, the image forming apparatus described in JP-A-2003-215874 needs to reverse a rotating direction of the stepping motor and accelerate the stepping motor after decelerates and stops the stepping motor when switching a rotating direction of the second discharge roller. Therefore, a downtime of the stepping motor becomes long and throughput is reduced when performing duplex printing.

In addition, it is considered that the stepping motor is configured to normally and reversely rotate a drive force transmitted to the second discharge roller by a gear train and the like while maintaining a state in which the stepping motor is rotated in one direction. However, even in such a configuration, when the rotating direction of the second discharge roller is switched by the gear train, a large load is applied in a direction in which the rotation of the stepping motor that is a drive source is hindered.

As a result, there is a problem that time for switching the rotating direction of the stepping motor becomes long and the throughput is reduced.

SUMMARY OF THE INVENTION

According to an aspect of this disclosure, there is provided an image forming apparatus including an image forming portion configured to forma toner image on a sheet, a fixing portion configured to fix the toner image, formed on the sheet by the image forming portion, to the sheet, a sheet discharge portion, comprising a discharge roller, configured to discharge the sheet, on which the toner image has been formed, to an outside of the apparatus, a reverse portion, comprising a reverse roller, configured to convey the sheet on which the toner image have been fixed on a first surface thereof by the fixing portion to the image forming portion again to form a toner image on a second surface opposite to the first surface thereof while the reverse roller rotating in a reverse rotating direction after rotating in a forward rotating direction, a drive source, a drive unit comprising a first drive train through which a driving force from the drive source is transmitted to the discharge roller, and a second drive train through which a driving force from the drive source is transmitted to the reverse roller, and a switching mechanism, provided on the second drive train, configured to switch a rotating direction of the reverse roller between the forward rotating direction and the reverse rotating direction with the discharge roller rotating in one direction.

The switching mechanism has a first planetary gear, a second planetary gear and a stop unit. The first planetary gear unit has a first internal gear to which the drive force is transmitted from the drive source, a first sun gear, a first planetary gear engaging with the first internal gear and the first sun gear, and configured to rotate around the first sun gear, and a first planetary carrier supporting the first planetary gear rotatably, transmitting the drive force to the reverse roller, and configured to rotate around a rotating axis of the first sun gear together with the first planetary gear. The second planetary gear unit has a second internal gear to which the drive force is transmitted from the drive source and which rotates in the same direction as that of the first internal gear, a second sun gear, a second planetary gear engaging with the second internal gear and the second sun gear, and configured to rotate around the second sun gear, and a second planetary carrier supporting the second planetary gear rotatably, engaging with the first planetary carrier, and configured to rotate around a rotating axis of the second sun gear together with the second planetary gear. Lastly, the stop unit selectively stops the first sun gear and the second sun gear.

In a case where the first sun gear is stopped by the stop unit, the first planetary carrier rotates in a first rotating direction so that the reverse roller rotates in the forward rotating direction, and in a case where the second sun gear is stopped by the stop unit, the first planetary carrier rotates in a second rotating direction opposite to the first rotating direction so that the reverse roller rotates in the reverse rotating direction.

In other respects there is provided the sheet conveying apparatus of the image forming apparatus.

Further features of the present invention will become apparent from the following description of exemplary embodiments with reference to the attached drawings.

DESCRIPTION OF THE EMBODIMENTS

Figure 1:
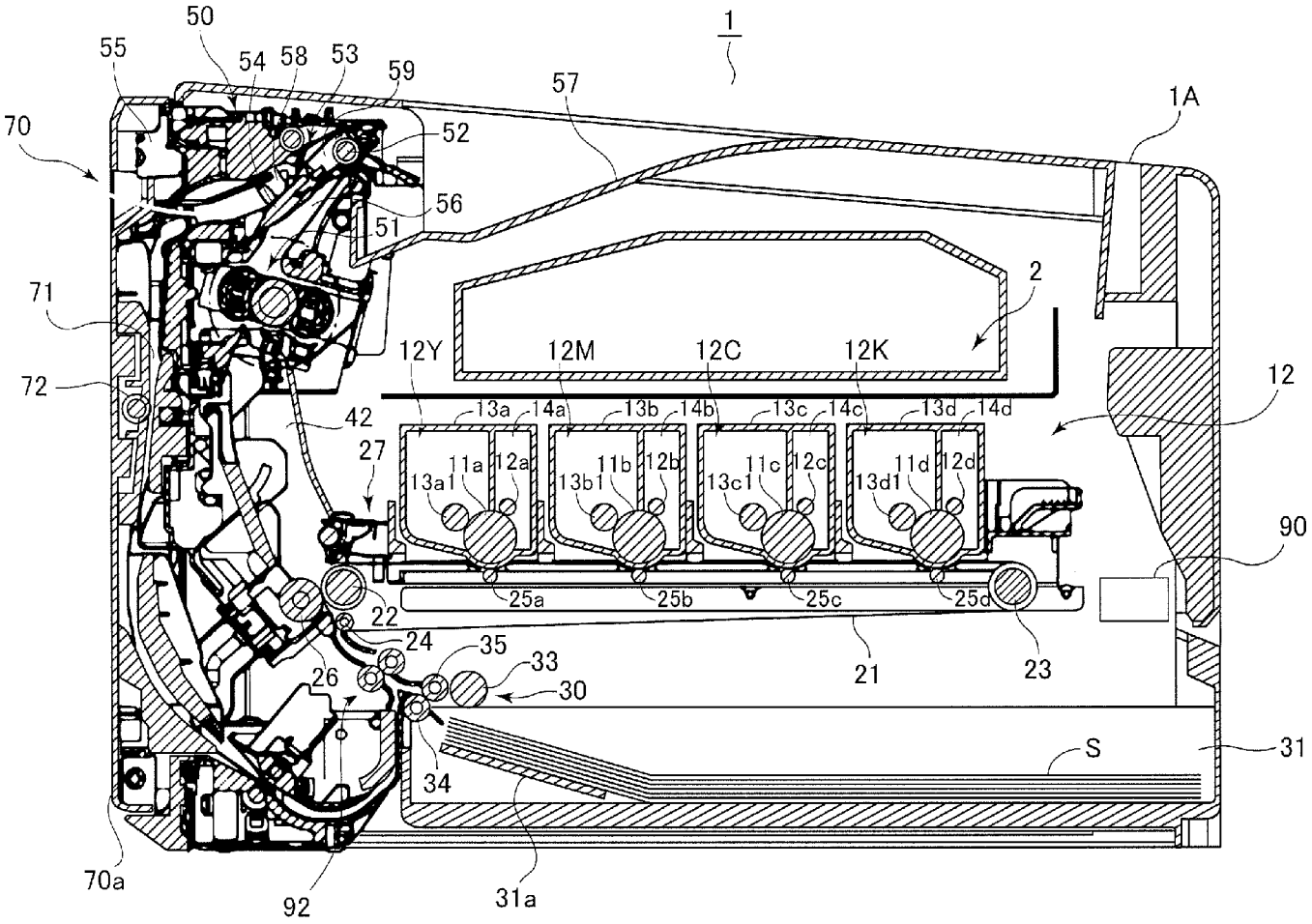
FIG. 1 is a schematic section view illustrating a printer according to an embodiment of this disclosure.

Hereinafter, an embodiment of this disclosure will be described in detail with reference to FIGS. 1 to 13. A printer 1 according to the embodiment of this disclosure is an electro-photographic system color laser beam printer which is an example of an image forming apparatus. As illustrated in FIG. 1, the printer 1 has a cassette 31, a sheet feeding unit 30, an image forming portion 12 that forms a toner image on a sheet, a fixing unit 51, a discharge roller pair 52, and a reverse roller pair 53.

If a command of image formation is output to the printer 1, an image formation process is started by the image forming portion 12 based on image information input from an external computer and the like connected to the printer 1. The image forming portion 12 includes a laser scanner unit 2 and four process cartridges 12Y, 12M, 12C, and 12K which form four colors of yellow (Y), magenta (M), cyan (C), and black (Bk). It is noted that the four process cartridges 12Y, 12M, 12C, and 12K have the same configuration except that the colors of an image to be formed are different, only the image formation process of the process cartridge 12Y is described, and description of the process cartridges 12M, 12C, and 12K will be omitted.

The laser scanner unit 2 applies a laser beam to a photosensitive drum 11*a* of the process cartridge 12Y based on input image information. In this case, the photosensitive drum 11*a* is charged in advance by a charger 12*a* and an electrostatic latent image is formed on the photosensitive drum 11*a* by applying the laser beam to the photosensitive drum 11*a*. Thereafter, the electrostatic latent image is developed by a developing roller 13*a*1 provided on the inside of a developer 13*a* and a toner image of yellow (Y) is formed on the photosensitive drum 11*a*.

Similarly, toner images of magenta (M), cyan (C), and black (Bk) are formed on the photosensitive drums of the process cartridges 12M, 12C, and 12K. The toner image of each color formed on each photosensitive drum is transferred to an intermediate transfer belt 21 by primary transfer rollers 25*a*, 25*b*, 25*c*, and 25*d*. The endless intermediate transfer belt 21 having dielectric property and flexible property is wound around a drive roller 22, a turn roller 23, and a tension roller 24. The intermediate transfer belt 21 is rotated by the drive roller 22, whereby the toner image on the intermediate transfer belt 21 is conveyed to a secondary transfer roller 26. It is noted that the image formation process of each color is performed at a timing of superimposing a toner image of each color on the toner image of an upstream that is primarily transferred onto the intermediate transfer belt 21.

Sheets stacked in the cassette 31 are fed by the sheet feeding unit 30 in parallel in the image formation process described above. The cassette 31 has an intermediate plate 31*a* that is pivotably supported, the intermediate plate 31*a* pivots, whereby the uppermost sheet S in a sheet bundle stacked on the intermediate plate 31*a* abuts against a sheet feeding roller 33. In this state, the sheets S are fed by the sheet feeding roller 33 and are separated one by one by a conveyance roller 35 and a separating roller 34.

Skew of the sheet S conveyed by the conveyance roller 35 and the separating roller 34 is corrected by a registration roller pair 92. A full color toner image on the intermediate transfer belt 21 is transferred on the sheet S, which is conveyed at a predetermined conveying timing by the registration roller pair 92, by the secondary transfer roller 26. After the toner image is transferred onto the sheet by the secondary transfer roller 26, toner remaining on the intermediate transfer belt 21 is recovered by a belt cleaning unit 27.

Figure 2:
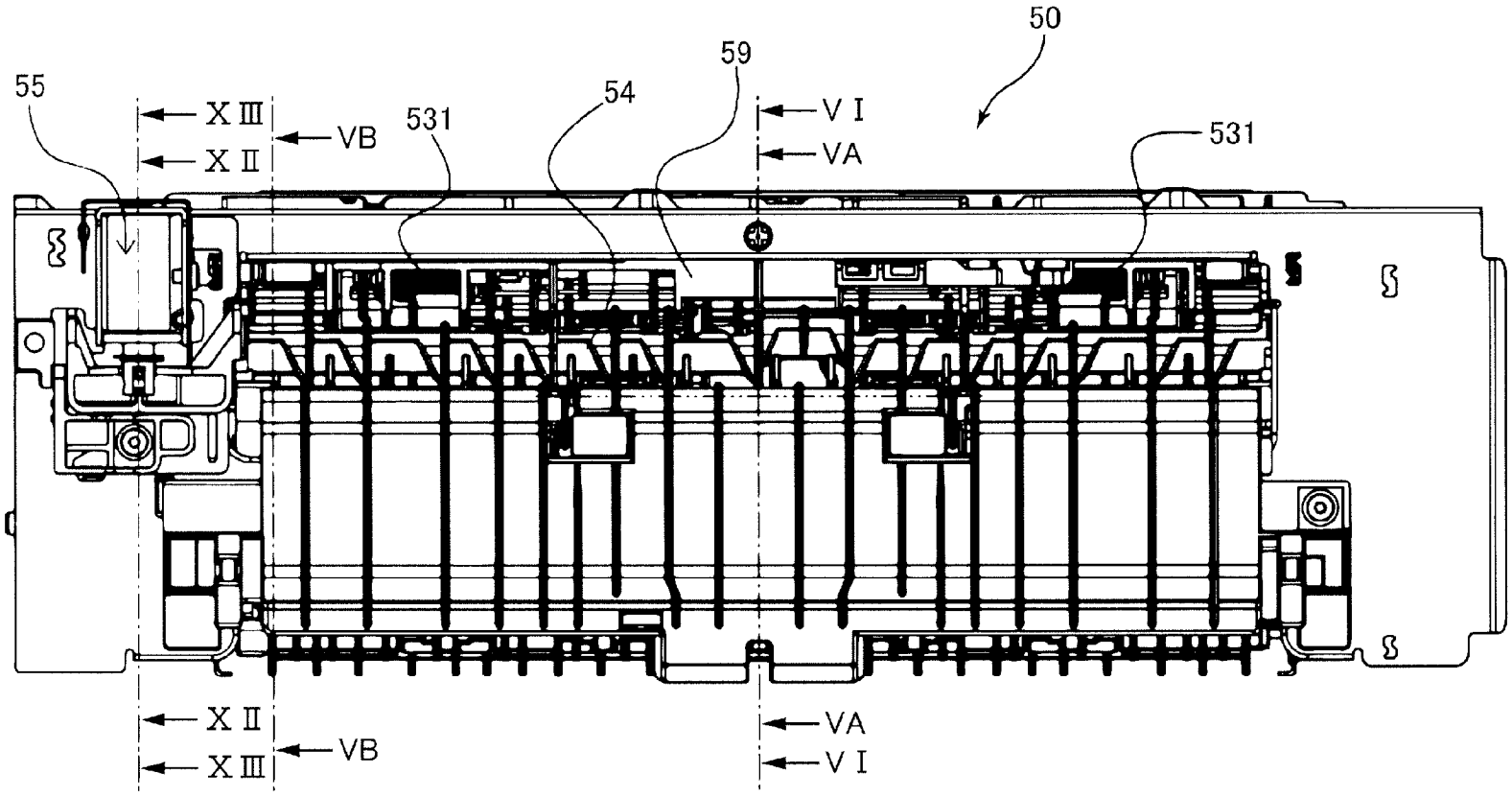
FIG. 2 is a rear view illustrating a fixing unit.

It is noted that a fixing unit 50 is provided on a downstream of the secondary transfer roller 26 in a direction of conveyance. The fixing unit 50 has the fixing unit 51, the discharge roller pair 52, the reverse roller pair 53 which is able to normally rotate and reversely rotate, a guide member 54, an actuator unit 55, and a discharge reverse guide 59, and these are unitized as illustrated in FIG. 2.

The sheet S to which the toner image is transferred is conveyed to the fixing unit 51 through a conveyance path 42. Then, predetermined heat and pressure are applied to the sheet S by the fixing unit 51 and toner is melted and fixed to the sheet S. The guide member 54, which is able to move to a discharge position and a reverse position, is provided in the downstream of the fixing unit 51 in the direction of conveyance. In a state in which the guide member 54 is positioned in the discharge position, i.e., first position, the sheet S is guided to the discharge roller pair 52 via a discharge conveyance path 56. Then, the sheet S is discharged to a sheet discharge tray 57 provided on an upper surface of an apparatus body 1A by the discharge roller pair 52. It is noted that the discharge reverse guide 59 pivotably supports the guide member 54 and configures a part of the discharge conveyance path 56 and a reverse conveying path 58.

In addition, for example, if duplex printing is performed on the sheet S, the guide member 54 is positioned in the reverse position, i.e., second position. Then, the toner image transferred onto the first surface is fixed by the fixing unit 51 and the sheet S passing through the fixing unit 51 is guided to the reverse roller pair 53 via the reverse conveying path 58.

The reverse roller pair 53 is reversed, whereby the sheet S conveyed to the reverse roller pair 53 is switched back at a predetermined timing (described in detail later) and the sheet S is conveyed to a re-conveyance unit 70 disposed on a side of the fixing unit 50. The re-conveyance unit 70 has a re-conveyance path 71 and a re-conveyance roller pair 72, and is pivotably supported on the apparatus body 1A around a pivotal shaft 70*a*. The sheet S is conveyed on the re-conveyance path 71 by the re-conveyance roller pair 72 and reaches the registration roller pair 92 again. It is noted that the re-conveyance unit 70 on the apparatus body 1A is opened whereby the re-conveyance path 71 is exposed and it is possible to easily remove a jammed sheet in the re-conveyance path 71.

Then, the sheet S is conveyed to the secondary transfer roller 26 at a predetermined timing by the registration roller pair 92, the toner image is transferred onto the second surface by the secondary transfer roller 26, and the toner image is fixed by the fixing unit 51. The sheet S is conveyed to the discharge roller pair 52 by the guide member 54 positioned in the discharge position and is discharged to the sheet discharge tray 57 by the discharge roller pair 52.

Figure 3:
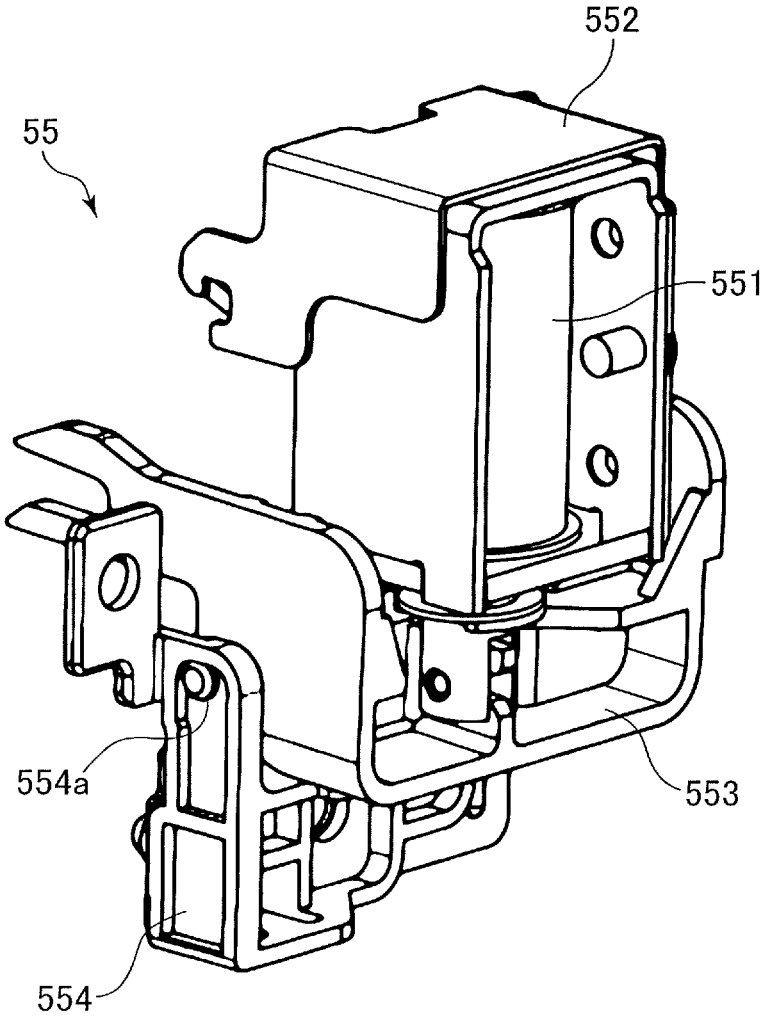
FIG. 3 is a perspective view illustrating an actuator unit.
Figure 4:
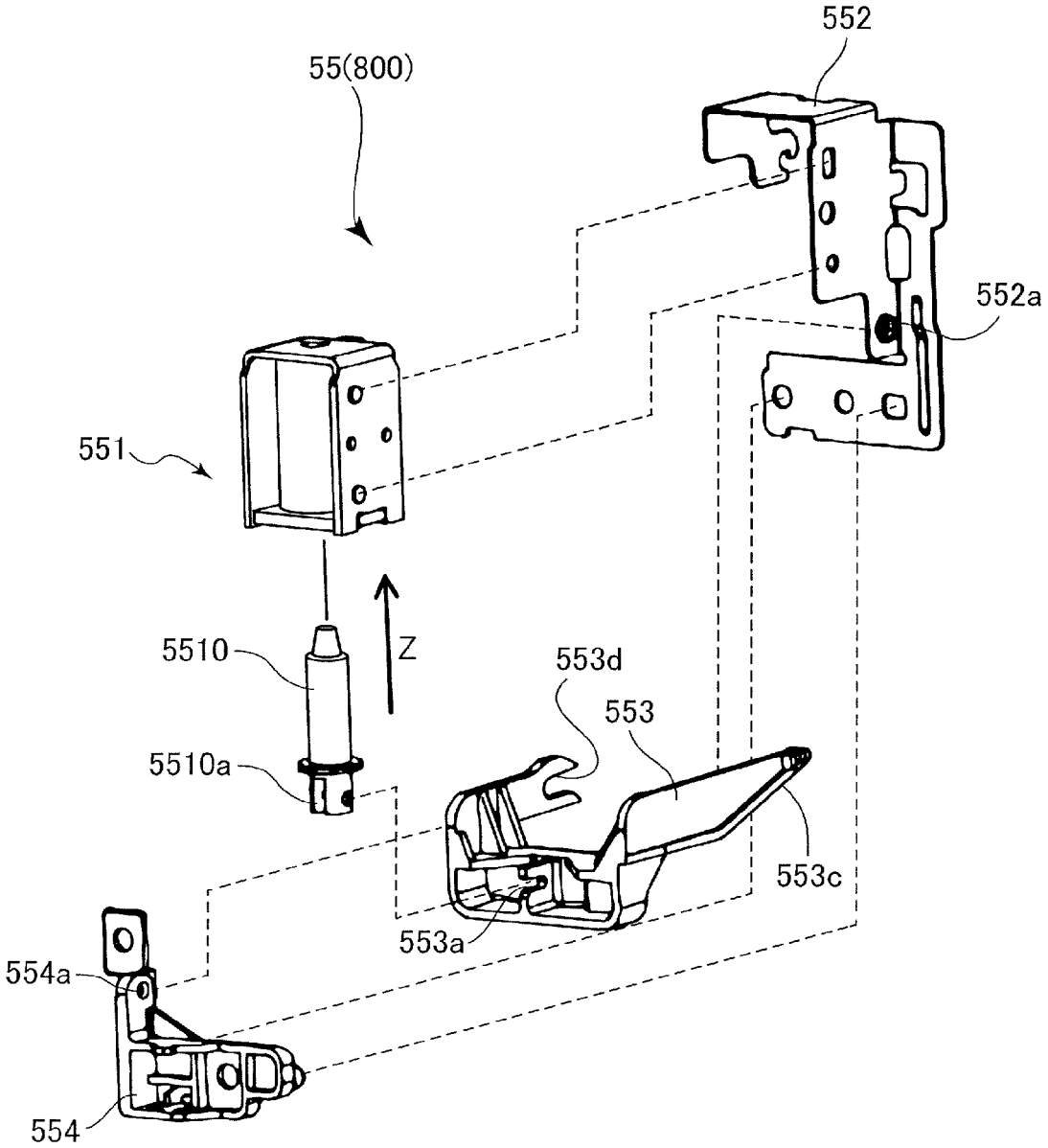
FIG. 4 is an exploded perspective view illustrating the actuator unit.

Next, the actuator unit 55 provided in the fixing unit 50 will be described. As illustrated in FIGS. 3 and 4, the actuator unit 55 has a solenoid retaining member 552 that is fixed to a frame (not illustrated) of the fixing unit 50 and a mounting member 554 that is fixed to the apparatus body 1A and is mounted on the solenoid retaining member 552. In addition, the actuator unit 55 has a lever 553, i.e., moving portion, that is pivotably supported on a bearing portion 552*a* of the solenoid retaining member 552 and a bearing portion 554*a* of the mounting member 554, and a solenoid 551 that is mounted on the solenoid retaining member 552.

As illustrated in FIG. 4, if the solenoid 551 is turned on by a control portion 90 (see FIG. 1) provided in the apparatus body 1A, a plunger 5510 is attracted in a Z direction and if the solenoid 551 is turned off by the control portion 90, the plunger 5510 falls in a –Z direction, i.e., direction, opposite to the Z direction, by its own weight. The plunger 5510 is configured such that a nipped portion 5510*a* that is nipped by a nipping portion 553*a* of the lever 553 is formed in a lower end.

Figure 5A:
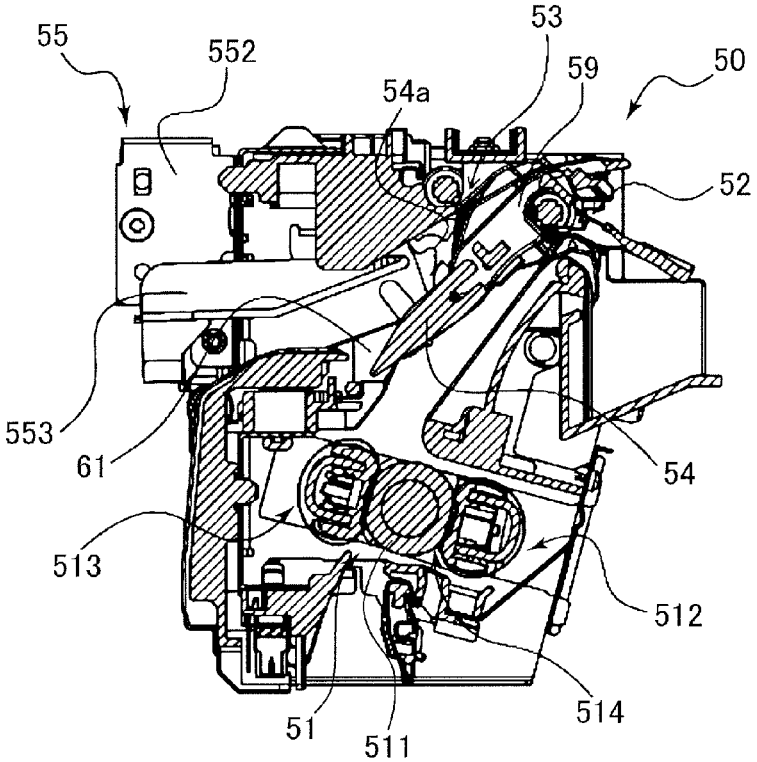
FIG. 5A is a section view that is taken along line VA-VA of FIG. 2 illustrating the fixing unit.
Figure 5B:
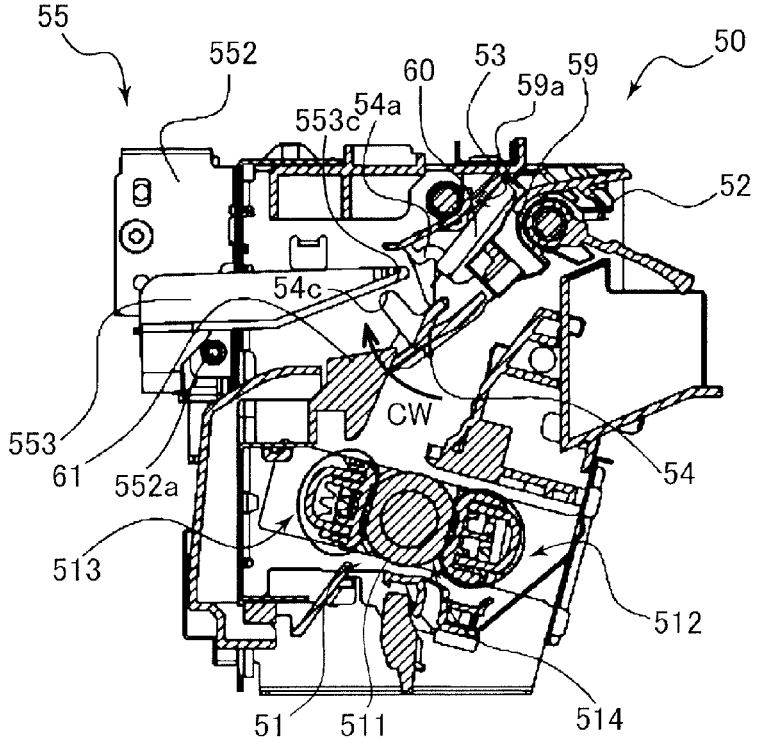
FIG. 5B is a section view that is taken along line VB-VB of FIG. 2 illustrating the fixing unit.

As illustrated in FIGS. 5A and 5B, the guide member 54 has a spring hooking portion 54*a* and is biased in a clockwise (hereinafter referred to as "CW") direction by a spring 60 stretching between a spring hooking portion 59*a* formed in the discharge reverse guide 59 and the spring hooking portion 54*a*. Then, the guide member 54 is retained in the discharge position by abutting against a guide 61. In addition, the guide member 54 has a pressed portion 54*c* abutting against the pressing portion 553*c* (see FIG. 4) formed in the end portion of the lever 553. It is noted that FIG. 5A is a section view that is taken along line VA-VA in FIG. 2 and FIG. 5B is a section view that is taken along line VB-VB in FIG. 2.

Figure 6:
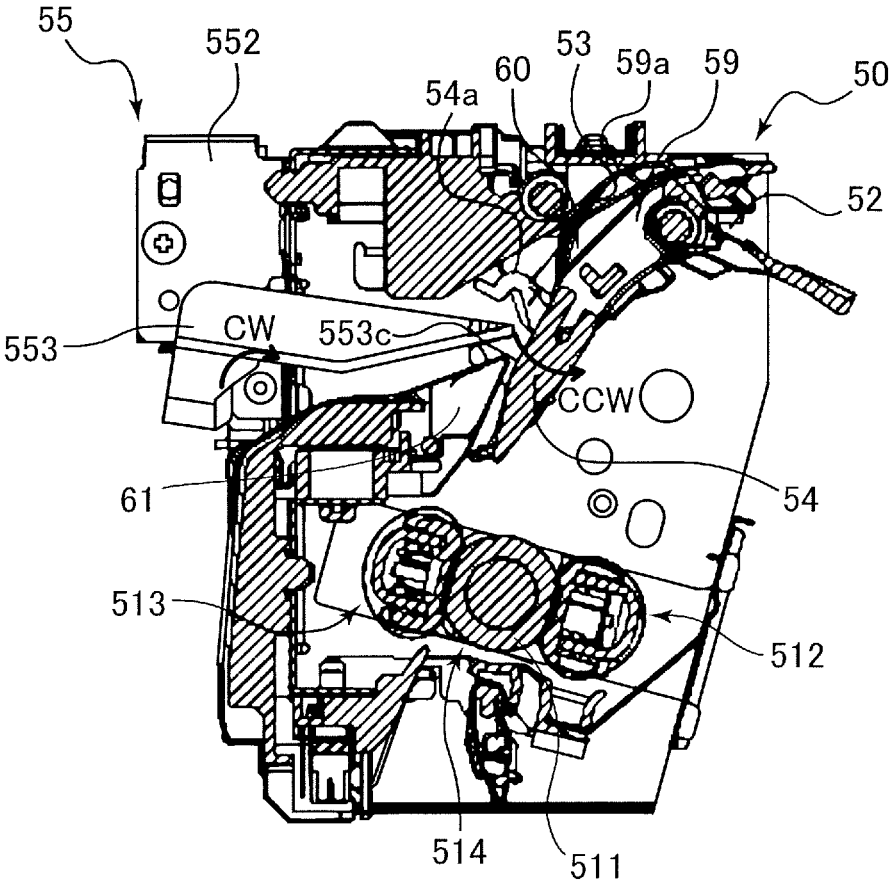
FIG. 6 is a section view that is taken along line VI-VI of FIG. 2 illustrating the fixing unit when a guide member is positioned in a discharge position.

Next, operations of the solenoid 551 and the guide member 54 will be described. If the control portion 90 turns off the solenoid 551, as illustrated in FIGS. 5A and 5B, the guide member 54 is retained in the discharge position by the spring 60 and the weight of the solenoid 551 itself. If the control portion 90 turns on the solenoid 551 from this state, the solenoid 551 is attracted in the Z direction illustrated in FIG. 4 and as illustrated in FIG. 6, the lever 553 pivots in the CW direction. The lever 553 pivots in the CW direction, whereby the pressing portion 553*c* of the lever 553 presses the pressed portion 54*c* of the guide member 54 (see FIG. 7). Therefore, the guide member 54 pivots in a counterclockwise (hereinafter referred to as "CCW") direction against a biasing force of the spring 60.

Figure 7:
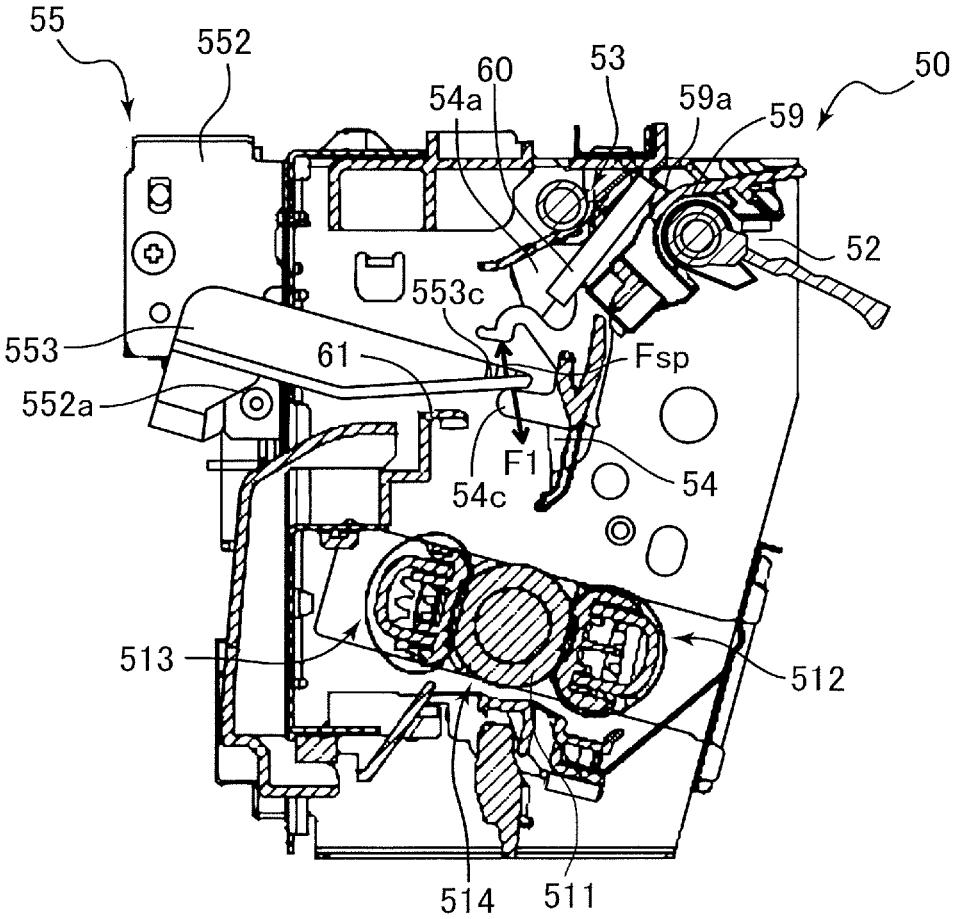
FIG. 7 is a section view illustrating the fixing unit when the guide member is positioned in a reverse position.

As illustrated in FIG. 7, in this state, the guide member 54 receives a force F1 from a pressing portion of the lever 553 and receives a force Fsp from the spring 60. Then, in the embodiment, a torque of the solenoid 551 and a resilient force of the spring 60 are set and the guide member 54 is configured to be pivotable in the CCW direction so as to satisfy a relationship of F1>Fsp. As described above, the guide member 54 pivots in the CCW direction, thereby abutting against a stopper (not illustrated) and being retained in the reverse position. It is noted that a configuration, in which a current flowing through the solenoid 551 is detected, the current is a predetermined value, whereby the guide member 54 is positioned in the reverse position, may be used without providing the stopper. In a state in which the guide member 54 is positioned in the reverse position, if the control portion 90 turns off the solenoid 551, the guide member 54 returns to the discharge position by its own weight and the biasing force of the spring 60.

Figure 8:
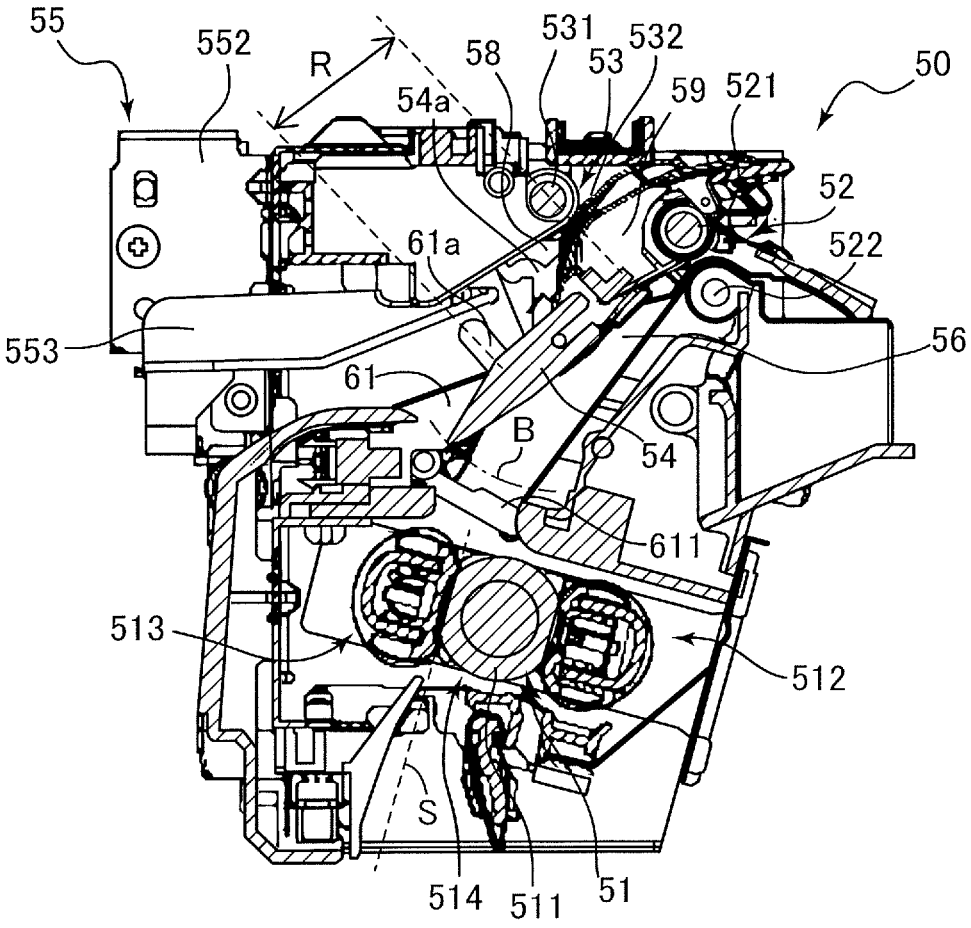
FIG. 8 is a section view illustrating the fixing unit.

The solenoid 551 is turned on or off, whereby the guide member 54 moves between the discharge position and the reverse position as described above. Therefore, in a case of simplex printing, as illustrated in FIG. 8, the control portion 90 turns off the solenoid 551 and positions the guide member 54 in the discharge position. Here, the fixing unit 51 has a fixing roller 511 that drives in one direction, a heating unit 512 that heats the fixing roller 511, and a pressing unit 513 that comes into pressure contact with the fixing roller 511. The sheet S is pressed and heated by the nip of the fixing roller 511 and the pressing unit 513, the toner image is fixed onto the sheet S, and then the sheet S is conveyed to the guide member 54. The sheet S is guided to the discharge conveyance path 56 by the guide member 54 and is discharged to the sheet discharge tray 57 by the discharge roller pair 52.

In a case of duplex printing, the control portion 90 detects the position of a leading end of the sheet S by a sensor (not illustrated) and turns on the solenoid 551 at a timing when the leading end of the sheet S is in an upstream from a conveyance path branching point B that is a locus of a tip end portion of the guide member 54. Therefore, the guide member 54 is positioned in the reverse position and the sheet S is guided to the reverse conveying path 58 by the guide member 54.

The control portion 90 detects the position of the trailing edge of the sheet S by a sensor 611 provided in the guide 61. Then, the control portion 90 turns off the solenoid 551 and positions the guide member 54 in the discharge position when the trailing edge of the sheet S is in a reversible area R from a position, in which the trailing end of the sheet S passes through a tip end 61*a* of the guide 61, to the reverse roller pair 53. Accordingly, as described below, the reverse roller pair 53 is reversed, and the sheet S is switched back and is guided to the re-conveyance unit 70 by the guide member 54.

Next, a switching mechanism that switches the rotating direction of the reverse roller pair 53 according to the embodiment will be described. It is noted that the reverse roller pair 53 is configured of a reverse roller 531 and a reverse driven roller 532, and the discharge roller pair 52 is configured of a discharge roller 521 and a discharge driven roller 522.

Figure 9:
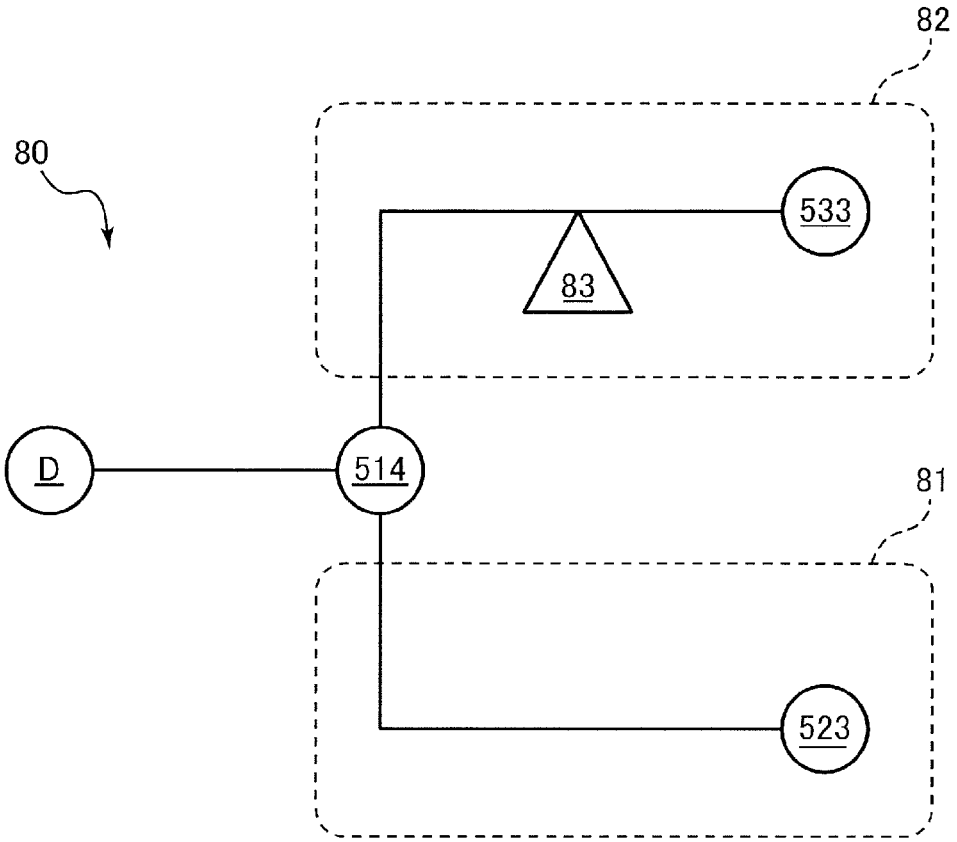
FIG. 9 is an explanatory view illustrating a drive transmission route of a drive force of a motor.

FIG. 9 is an explanatory view of a drive transmission route 80, i.e., drive unit, in the embodiment. First, as illustrated in FIG. 9, the drive force generated by a motor D that is the drive source is transmitted to a fixing roller gear 514 provided coaxially with the fixing roller 511. The drive transmission route 80 has a first drive transmission route 81, i.e., first drive train, and a second drive transmission route 82, i.e., second drive train, which are respectively branched from the fixing roller gear 514. That is, the motor D transmits the drive force to the fixing unit 51 in the upstream of the first drive transmission route 81 and the second drive transmission route 82 in the drive transmission direction.

The first drive transmission route 81 transmits the drive force transmitted to the fixing roller gear 514 to a discharge roller gear 523 provided coaxially with the discharge roller 521. The second drive transmission route 82 transmits the drive force transmitted to the fixing roller gear 514 to a reverse roller gear 533 provided coaxially with the reverse roller 531. Then, a switching mechanism 83 that switches the rotating direction of the reverse roller 531 is provided on the second drive transmission route 82.

Figure 10A:
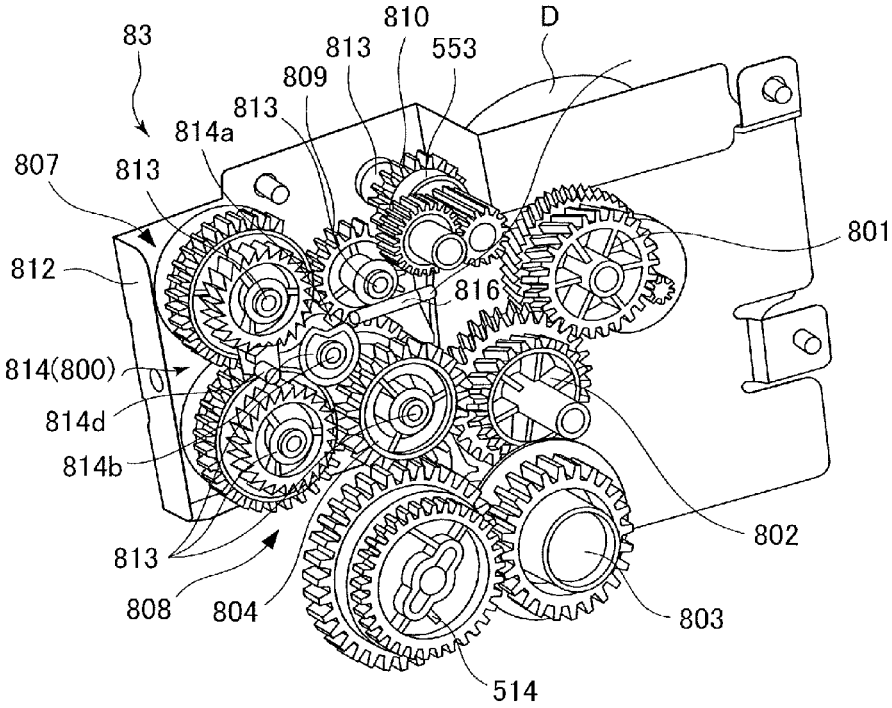
FIG. 10A is a front perspective view illustrating a switching mechanism.
Figure 10B:
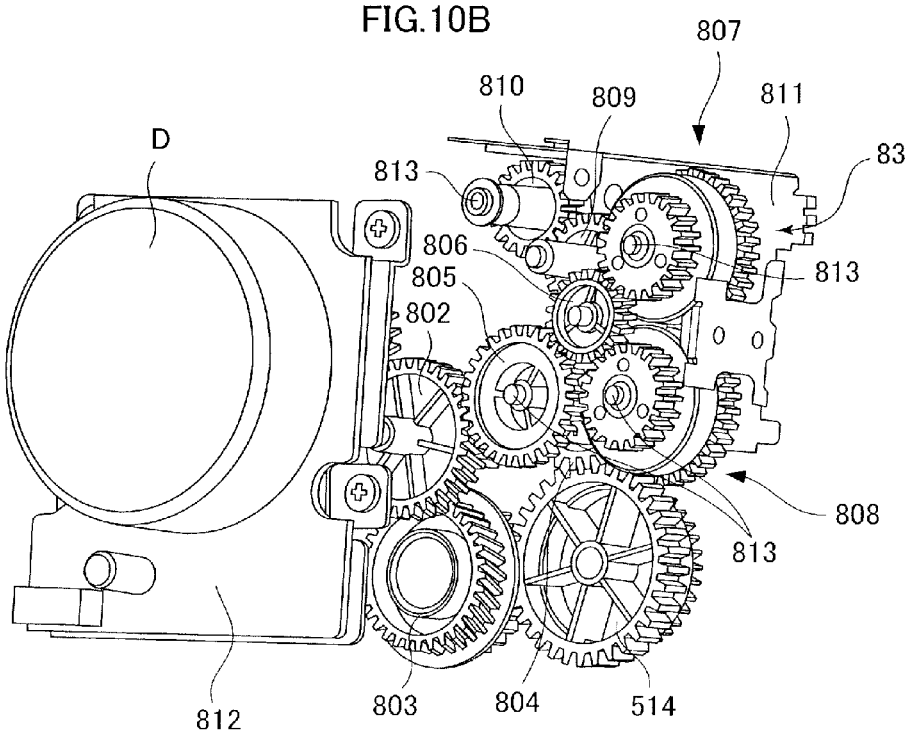
FIG. 10B is a rear perspective view illustrating the switching mechanism.

Next, particularly, the switching mechanism 83 will be described in detail. As illustrated in FIGS. 10A and 10B, the drive force of the motor D is transmitted to the fixing roller gear 514 via gears 801, 802, and 803. It is noted that, in FIGS. 10A and 10B, a specific configuration of the second drive transmission route 82 is omitted and the drive force of the fixing roller gear 514 is transmitted to the discharge roller gear 523 via a gear train (not illustrated).

A gear 804 is in engagement with the fixing roller gear 514, and a gear 805 is provided coaxially with the gear 804. A gear 806 is in engagement with the gear 805, and a first planetary gear mechanism 807, i.e., first planetary gear portion, and a second planetary gear mechanism 808, i.e., second planetary gear portion, are in engagement with the gear 806. A planetary carrier 807*b* (described below) of the first planetary gear mechanism 807 is in engagement with a gear 809 and a drive force of the gear 809 is transmitted to the reverse roller gear 533 via a gear 810.

The motor D, the gears 801 to 806, 809, and 810, the fixing roller gear 514, the first planetary gear mechanism 807, the second planetary gear mechanism 808, and the reverse roller gear 533 are unitized by a drive base 811, a drive cover 812 and a plurality of shafts 813, and are mounted on the apparatus body.

Figure 11:
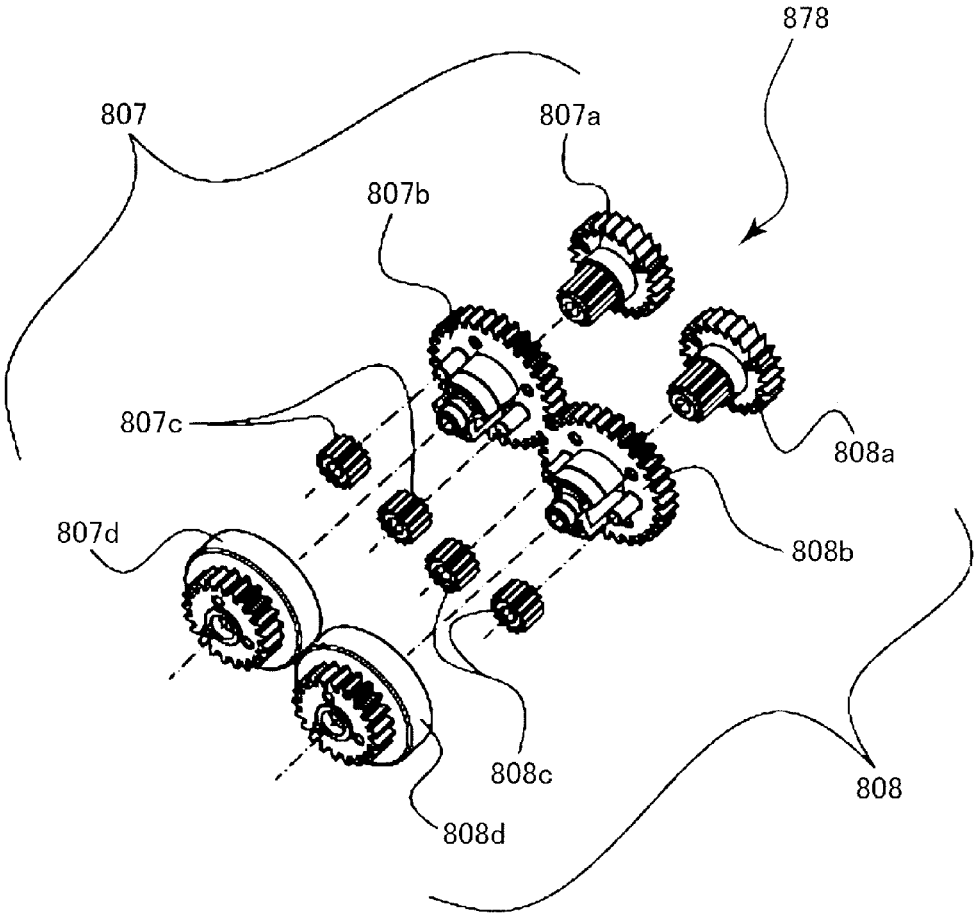
FIG. 11 is an exploded perspective view illustrating first and second planetary gear mechanisms.

As illustrated in FIG. 11, two adjacent planetary gear mechanisms 807 and 808 are respectively configured of sun gears 807*a* and 808*a*, planetary carriers 807*b* and 808*b*, two planetary gears 807*c* and 808*c*, and internal gears 807*d* and 808*d*. In addition, the planetary gear mechanisms 807 and 808 configure a planetary gear apparatus 878.

As described above, two internal gears 807*d* and 808*d*, i.e., first rotation element and fourth rotation element, are in engagement with the gear 806 driven by the motor D and are rotated in the same direction. The internal gear 807*d*, i.e., first rotation element, is in engagement with two planetary gears 807*c* and 807*c* which are rotatably mounted on the planetary carrier 807*b*, i.e., second rotation element. In addition, the planetary gears 807*c* and 807*c* are in engagement with the sun gear 807*a*, i.e., third rotation element.

Similarly, the internal gear 808*d*, i.e., fourth rotation element, is in engagement with two planetary gears 808*c* and 808*c* which are rotatably mounted on the planetary carrier 808*b*, i.e., fifth rotation element. In addition, the planetary gears 808*c* and 808*c* are in engagement with the sun gear 808*a*, i.e., sixth rotation element. In addition, the planetary carriers 807*b* and 808*b* are in engagement with each other and the planetary carrier 807*b* outputs the drive force to the gear 809.

As illustrated in FIGS. 10A and 10B, a stopper 814 is provided coaxially with the gear 806 to be relatively rotatable with respect to the gear 806. The stopper 814 has a first engagement portion 814*a* that is able to engage and stop the sun gear 807*a*, a second engagement portion 814*b* that is able to engage and stop the sun gear 808*a*, and a nipped portion 814*d*. The stopper 814 is biased by a spring 816 of which one end is fixed to a spring hooking portion 811*a* of the drive cover 812 so that the first engagement portion 814*a* engages with the sun gear 807*a*. It is noted that when the first engagement portion 814*a* engages with the sun gear 807*a*, the second engagement portion 814*b* does not engage with the sun gear 808*a* and the guide member 54 is positioned in the discharge position.

In addition, as illustrated in FIG. 4, the lever 553 has a nipping portion 553*d* that nips the nipped portion 814*d* of the stopper 814. The solenoid 551 is turned on and the lever 553 pivots, whereby the stopper 814 is pivoted against the biasing force of the spring 816. Therefore, the first engagement portion 814*a* moves away from the sun gear 807*a*, the second engagement portion 814*b* is in engagement with the sun gear 808*a*, and the guide member 54 is positioned in the reverse position. That is, the stopper 814 selectively stops the sun gear 807*a* and the sun gear 808*a*. It is noted that, in the embodiment, a stop unit 800 is configured of the actuator unit 55 and the stopper 814. The switching mechanism 83 has the first planetary gear mechanism 807, the second planetary gear mechanism 808, and the stop unit 800.

Figure 12:
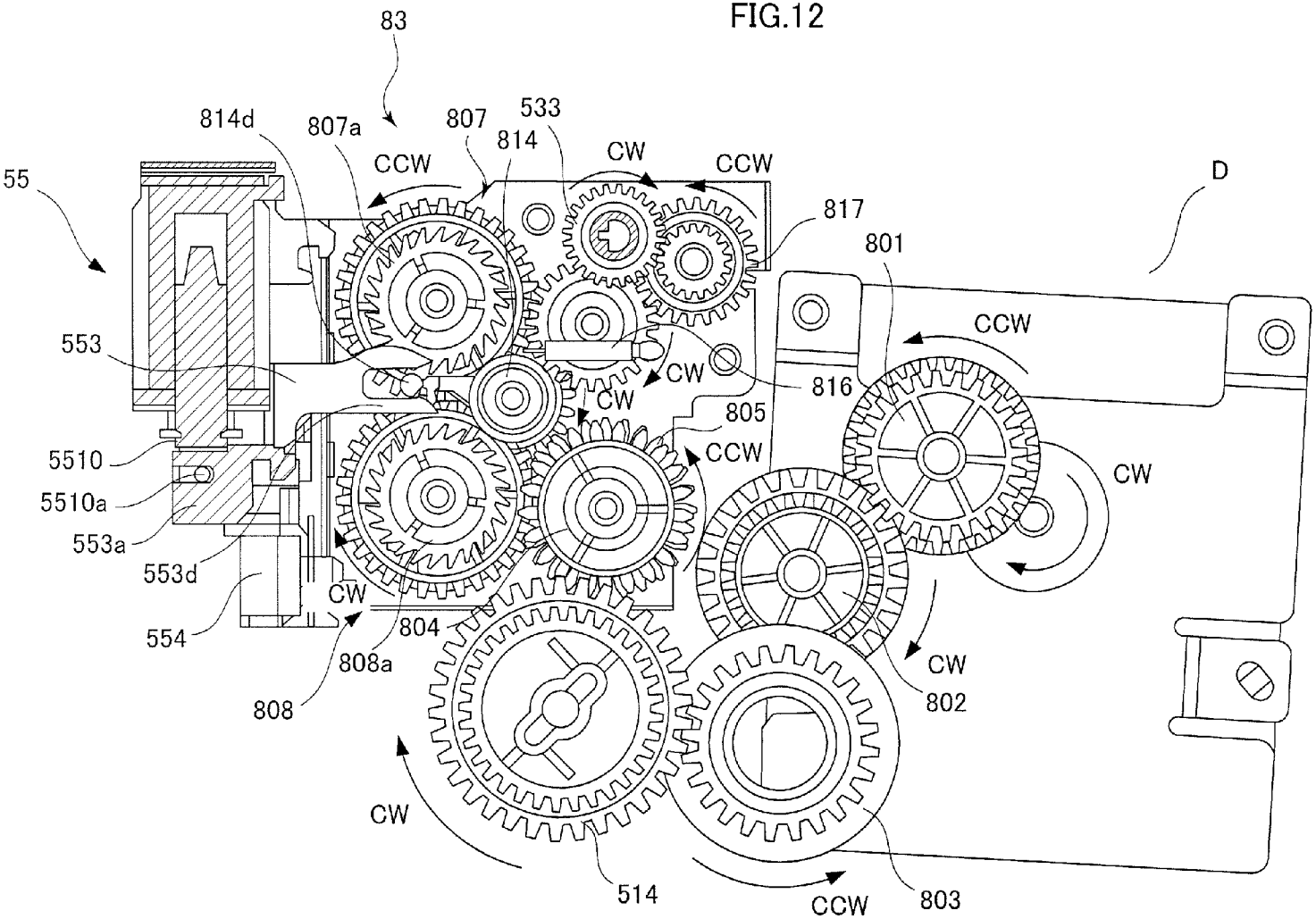
FIG. 12 is a section view illustrating a rotating direction of each gear when a guide member is positioned in a discharge position.
Figure 13:
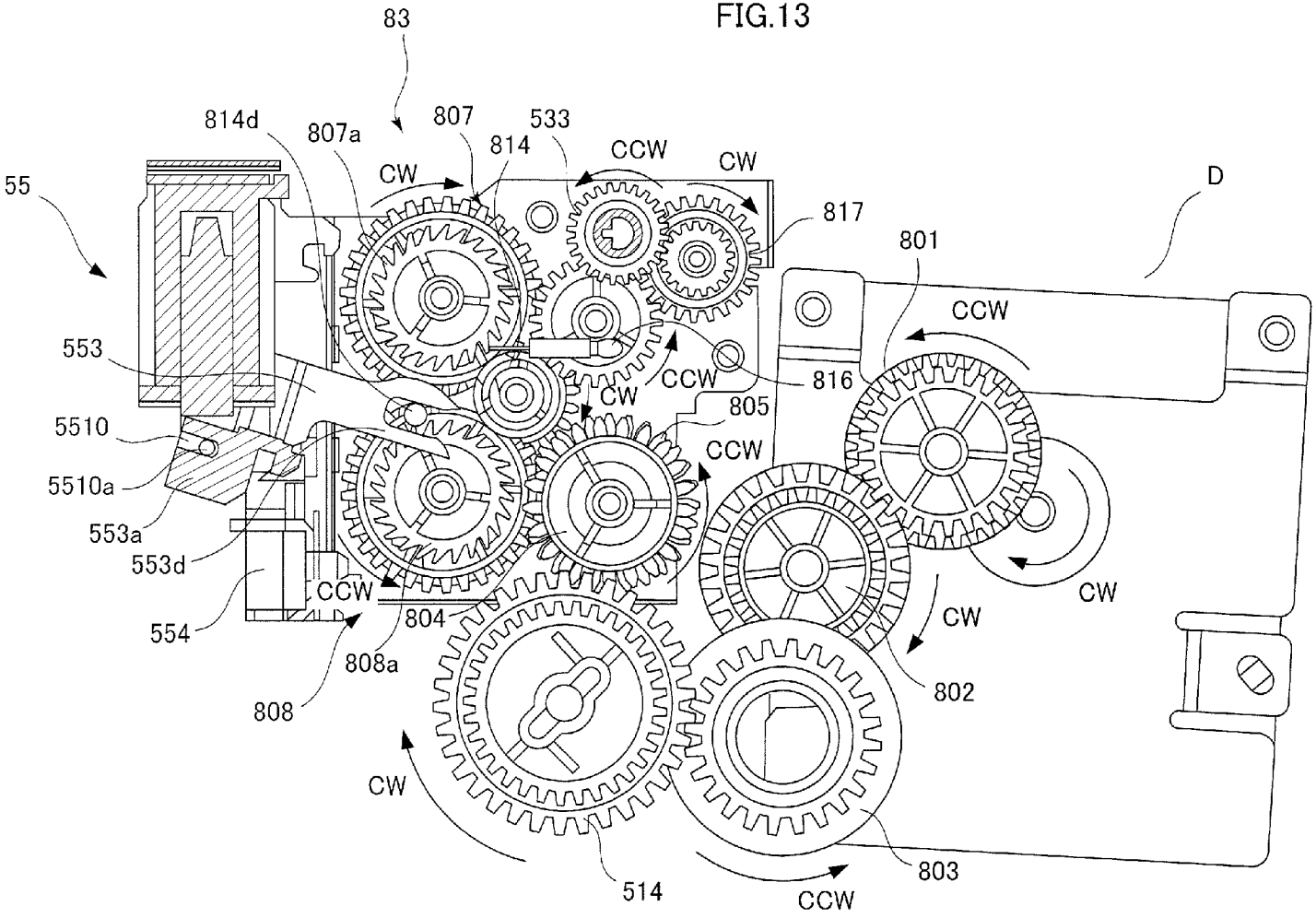
FIG. 13 is a section view illustrating the rotating direction of each gear when the guide member is positioned in a reverse position.

Next, a switching operation of the rotating direction of the reverse roller 531 by the switching mechanism 83 will be described. FIG. 12 illustrates the rotating direction of each gear on the first drive transmission route 81 when the guide member 54 is positioned in the discharge position. FIG. 13 illustrates the rotating direction of each gear on the first drive transmission route 81 when the guide member 54 is positioned in the reverse position. It is noted that FIGS. 12 and 13 are section views that are respectively taken along line XII-XII and line XIII-XIII of FIG. 2.

When the solenoid 551 is turned off, as illustrated in FIG. 12, the reverse roller gear 533 and the reverse roller 531 are rotated in the CW direction, i.e., first rotating direction. Specifically, as described above, the first engagement portion 814*a* is in engagement with the sun gear 807*a* and the sun gear 807*a* is stopped. The internal gears 807*d* and 808*d* are rotated in the CCW direction, and the planetary carrier 807*b* is decelerated and is rotated in the CCW direction by the gear 806 rotating in the CW direction. The rotation of the planetary carrier 807*b* rotating in the CCW direction is transmitted to the reverse roller 531 via the gears 809 and 810 and the reverse roller gear 533, and the reverse roller 531 is rotated in the CW direction. It is noted that, in this case, the guide member 54 is positioned in the discharge position. The motor D, the fixing roller 511, and the discharge roller 521 are rotated in the CW direction.

Then, when switching the reverse roller gear 533 and the reverse roller 531 to be rotated in the CCW direction, the control portion 90 turns on the solenoid 551. Then, as illustrated in FIG. 13, the lever 553 pivots and the stopper 814 pivots against the biasing force of the spring 816. Therefore, the first engagement portion 814*a* moves away from the sun gear 807*a*, the second engagement portion 814*b* is in engagement with the sun gear 808*a*, and the sun gear 808*a* is in a stop state.

The internal gears 807*d* and 808*d* are rotated in the CCW direction and the planetary carrier 807*b* is decelerated and is rotated in the CW direction by the gear 806 rotating in the CW direction. The rotation of the planetary carrier 807*b* rotating in the CW direction is transmitted to the reverse roller 531 via the gears 809 and 810, and the reverse roller gear 533. The reverse roller 531 is rotated in the CCW direction, i.e., second rotating direction, that is the direction opposite to the CW direction. It is noted that, in this case, the guide member 54 is positioned in the reverse position, and the motor D, the fixing roller 511, and the discharge roller 521 are rotated in the CW direction.

Furthermore, if the solenoid 551 is turned off from on, a procedure reverse to the procedure described above is followed and the rotating direction of the discharge roller 521 is switched from in the CW direction to in the CCW direction. Also, in this case, the motor D, the fixing roller 511, and the discharge roller 521 are still rotated in the CW direction. It is noted that, in a moment when the rotating direction of the reverse roller 531 is changed, a load is applied to the motor D in a direction opposite to the direction in which the motor D is rotated.

Here, an equivalent mass of the motor D continuously rotated in the CW direction and the fixing roller 511 on conveyance is M1 and an equivalent mass of the discharge roller 521 on conveyance is M2. When a total equivalent mass on a side on which rotation is always provided in the CW direction is M, M=M1+M2 is satisfied. If an equivalent mass of the reverse roller 531 that is normally and reversely rotated on conveyance is m, in general, since the equivalent mass M is greater than the equivalent mass m, an equivalent mass ratio to rotate in the CW direction is increased. As a result, it is possible to reduce the load applied to the motor D when the reverse roller 531 is reversely rotated. In addition, as M/m is larger, it is possible to reduce the load applied to the motor D. Here, the equivalent mass is obtained by converting the moment of inertia as a mass to be an inertial force equivalent in speed on the conveyance.

In other words, in the embodiment, the fixing roller 511 and the discharge roller 521 are always rotated in one direction (CW direction) and only the rotating direction of the reverse roller 531 is switched by the switching mechanism 83. Therefore, the fixing roller 511 and the discharge roller 521 act as inertia on the motor D side and when the rotating direction of the reverse roller 531 is switched, even if the load is applied to the motor D, a constant speed of the motor is maintained by the inertia.

Therefore, it is possible to reduce a load hindering the rotation generated by the motor D and it is possible to reduce time during switch-back of the sheet S. As a result, it is possible to provide the image forming apparatus capable of improving the throughput and capable of performing duplex printing with high productivity.

In addition, the first planetary gear mechanism 807 and the second planetary gear mechanism 808 have the same configuration, can use common parts, and can reduce costs. In addition, it is possible to downsize the mechanism by using the planetary gear mechanism compared to a gear train in which spur gears are arranged in a radius direction. In addition, even if two planetary gear mechanisms are used, since the drive force is output from the planetary carrier 807*b* that is always the same rotation element, it is possible to transmit stable rotation to the reverse roller 531.

It is noted that, in the embodiment, a configuration, in which the fixing roller 511, the discharge roller 521, and the reverse roller 531 are driven by the motor D, is used, but the invention is not limited to the embodiment. For example, the fixing roller 511 may be driven by another motor.

In addition, in the embodiment, switching of the rotating direction of the reverse roller 531 and the pivot of the guide member 54 are performed by the common solenoid 551, but another solenoid may be used.

In addition, in the embodiment, the planetary gear mechanisms 807 and 808 input the drive force from the internal gears 807*d* and 808*d*, and the drive force is output from the planetary carrier 807*b*, but the invention is not limited to the embodiment. That is, three rotation elements of the sun gear, the planetary gear, and the internal gear may appropriately be used to be allocated to an input element, a fixing element, and an output element.

In addition, in the embodiment, the switching mechanism 83 has two planetary gear mechanisms 807 and 808, but the invention is not limited to the embodiment. For example, the drive force may be reversely transmitted from the sun gear or the internal gear to the reverse roller 531 by using one planetary gear and a clutch. In addition, the drive force may be reversely transmitted from the motor D to the reverse roller 531 by using the gear train and two clutches without using the planetary gear mechanism.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-108835, filed May 28, 2015, which is hereby incorporated by reference herein in its entirety.

What is claimed is:

1. An image forming apparatus comprising:

an image forming portion configured to form a toner image on a sheet;

a fixing portion configured to fix the toner image, formed on the sheet by the image forming portion, to the sheet;

a sheet discharge portion, comprising a discharge roller, configured to discharge the sheet, on which the toner image has been formed, to an outside of the apparatus;

a reverse portion, comprising a reverse roller, configured to convey the sheet on which the toner image have been fixed on a first surface thereof by the fixing portion to the image forming portion again to form a toner image on a second surface opposite to the first surface thereof while the reverse roller rotating in a reverse rotating direction after rotating in a forward rotating direction;

a drive source;

a drive unit comprising a first drive train through which a driving force from the drive source is transmitted to the discharge roller, and a second drive train through which a driving force from the drive source is transmitted to the reverse roller; and a switching mechanism, provided on the second drive train, configured to switch a rotating direction of the reverse roller between the forward rotating direction and the reverse rotating direction with the discharge roller rotating in one direction, wherein the switching mechanism comprises:

a first planetary gear unit comprising:

a first internal gear to which the drive force is transmitted from the drive source;

a first sun gear;

a first planetary gear engaging with the first internal gear and the first sun gear, and configured to rotate around the first sun gear; and a first planetary carrier supporting the first planetary gear rotatably, transmitting the drive force to the reverse roller, and configured to rotate around a rotating axis of the first sun gear together with the first planetary gear;

a second planetary gear unit comprising:

a second internal gear to which the drive force is transmitted from the drive source and which rotates in the same direction as that of the first internal gear;

a second sun gear;

a second planetary gear engaging with the second internal gear and the second sun gear, and configured to rotate around the second sun gear; and a second planetary carrier supporting the second planetary gear rotatably, engaging with the first planetary carrier, and configured to rotate around a rotating axis of the second sun gear together with the second planetary gear; and a stop unit which selectively stops the first sun gear and the second sun gear, and wherein in a case where the first sun gear is stopped by the stop unit, the first planetary carrier rotates in a first rotating direction so that the reverse roller rotates in the forward rotating direction, and in a case where the second sun gear is stopped by the stop unit, the first planetary carrier rotates in a second rotating direction opposite to the first rotating direction so that the reverse roller rotates in the reverse rotating direction.

2. The image forming apparatus according to claim 1, further comprising a guide member movable between a first position in which the guide member guides the sheet to the sheet discharge portion and a second position in which the guide member guides the sheet to the reverse portion, the guide member being provided downstream of the fixing portion in a sheet conveyance direction.

3. The image forming apparatus according to claim 2, wherein the guide member is positioned in the first position in a case where the first sun gear is stopped by the stop unit, and is positioned in the second position in a case where the second sun gear is stopped by the stop unit.

4. The image forming apparatus according to claim 1, wherein the drive source transmits the drive force to the fixing portion on an upstream of the first drive train and the second drive train in a drive transmission direction.

5. A sheet conveying apparatus comprising:

a first conveying portion, comprising a first roller, configured to convey the sheet;

a second conveying portion, comprising a second roller, configured to convey the sheet, the second roller being configured to rotate in a forward rotating direction and in a reverse rotating direction;

a drive source;

a drive unit comprising a first drive train through which a driving force from the drive source is transmitted to the first roller, and a second drive train through which a driving force from the drive source is transmitted to the second roller; and a switching mechanism, provided on the second drive train, configured to switch a rotating direction of the second roller between the forward rotating direction and the reverse rotating direction with the first roller rotating in one direction, wherein the switching mechanism comprises:

a first planetary gear unit comprising:

a first internal gear to which the drive force is transmitted from the drive source;

a first sun gear;

a first planetary gear engaging with the first internal gear and the first sun gear, and configured to rotate around the first sun gear; and a first planetary carrier supporting the first planetary gear rotatably, transmitting the drive force to the second roller, and configured to rotate around a rotating axis of the first sun gear together with the first planetary gear;

a second planetary gear unit comprising:

a second internal gear to which the drive force is transmitted from the drive source and which rotates in the same direction as that of the first internal gear;

a second sun gear;

a second planetary gear engaging with the second internal gear and the second sun gear, and configured to rotate around the second sun gear; and a second planetary carrier supporting the second planetary gear rotatably, engaging with the first planetary carrier, and configured to rotate around a rotating axis of the second sun gear together with the second planetary gear; and a stop unit which selectively stops the first sun gear and the second sun gear, and wherein in a case where the first sun gear is stopped by the stop unit, the first planetary carrier rotates in a first rotating direction so that the second roller rotates in the forward rotating direction, and in a case where the second sun gear is stopped by the stop unit, the first planetary carrier rotates in a second rotating direction opposite to the first rotating direction so that the second roller rotates in the reverse rotating direction.

6. An image forming apparatus comprising:

an image forming portion configured to form a toner image on a sheet;

a fixing portion configured to fix the toner image, formed on the sheet by the image forming portion, to the sheet;

a sheet discharge portion, comprising a discharge roller, configured to discharge the sheet, on which the toner image has been formed, to an outside of the apparatus;

a reverse portion, comprising a reverse roller, configured to convey the sheet on which the toner image have been fixed on a first surface thereof by the fixing portion to the image forming portion again to form a toner image on a second surface opposite to the first surface thereof while the reverse roller rotating in a reverse rotating direction after rotating in a forward rotating direction;

a drive source;

a drive unit comprising a first drive train through which a driving force from the drive source is transmitted to the discharge roller, and a second drive train through which a driving force from the drive source is transmitted to the reverse roller; and a switching mechanism, provided on the second drive train, configured to switch a rotating direction of the reverse roller between the forward rotating direction and the reverse rotating direction with the discharge roller rotating in one direction, wherein the switching mechanism comprises:

a first planetary gear unit comprising:

a first internal gear, a first sun gear, a first planetary gear engaging with the first internal gear and the first sun gear, and a first planetary carrier supporting the first planetary gear rotatably, and a second planetary gear unit engaging with the first planetary gear unit and comprising:

a second internal gear, a second sun gear, a second planetary gear engaging with the second internal gear and the second sun gear, and a second planetary carrier supporting the second planetary gear rotatably.

7. A sheet conveying apparatus comprising:

a first conveying portion, comprising a first roller, configured to convey the sheet;

a second conveying portion, comprising a second roller, configured to convey the sheet, the second roller being configured to rotate in a forward rotating direction and in a reverse rotating direction;

a drive source;

a drive unit comprising a first drive train through which a driving force from the drive source is transmitted to the first roller, and a second drive train through which a driving force from the drive source is transmitted to the second roller; and a switching mechanism, provided on the second drive train, configured to switch a rotating direction of the second roller between the forward rotating direction and the reverse rotating direction with the first roller rotating in one direction, wherein the switching mechanism comprises:

a first planetary gear unit comprising:

a first internal gear, a first sun gear, a first planetary gear engaging with the first internal gear and the first sun gear, and a first planetary carrier supporting the first planetary gear rotatably, and a second planetary gear unit engaging with the first planetary gear unit and comprising:

a second internal gear, a second sun gear, a second planetary gear engaging with the second internal gear and the second sun gear, and a second planetary carrier supporting the second planetary gear rotatably.

* * * * *